US010819002B2

(12) United States Patent
Zhu et al.

(10) Patent No.: US 10,819,002 B2
(45) Date of Patent: Oct. 27, 2020

(54) AOG ANTENNA SYSTEM AND MOBILE TERMINAL

(71) Applicant: AAC Technologies Pte. Ltd., Singapore (SG)

(72) Inventors: Zhimin Zhu, Shenzhen (CN); Xiaoyue Xia, Shenzhen (CN); Zhengdong Yong, Shenzhen (CN); Wei Zhao, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,091

(22) Filed: Jul. 28, 2019

(65) Prior Publication Data

US 2020/0052367 A1 Feb. 13, 2020

(30) Foreign Application Priority Data

Aug. 12, 2018 (CN) ..... 2018 1 0911474

(51) Int. Cl.

| | |
|---|---|
| ***H01Q 21/08*** | (2006.01) |
| ***H01Q 1/12*** | (2006.01) |
| ***H01Q 5/30*** | (2015.01) |
| ***H01Q 1/24*** | (2006.01) |
| ***H01Q 9/04*** | (2006.01) |

(52) U.S. Cl.

CPC ..... *H01Q 1/1271* (2013.01); *H01Q 1/243* (2013.01); *H01Q 5/30* (2015.01); *H01Q 9/0407* (2013.01); *H01Q 21/08* (2013.01)

(58) Field of Classification Search

CPC ..... H01Q 1/243; H01Q 1/1271; H01Q 1/242; H01Q 1/2283; H01Q 9/0457; H01Q 9/0407; H01Q 9/0414; H01Q 21/08; H01Q 21/28; H01Q 21/065; H01Q 5/30; H04M 1/0249; H04M 1/026; H04M 1/0202

See application file for complete search history.

(56) References Cited

U.S. PATENT DOCUMENTS

| | | | | |
|---|---|---|---|---|
| 10,700,410 | B2 * | 6/2020 | Lu | H01L 23/28 |
| 2019/0312334 | A1 * | 10/2019 | Shin | H04M 1/0249 |
| 2020/0044311 | A1 * | 2/2020 | Gu | H01Q 1/243 |
| 2020/0052394 | A1 * | 2/2020 | Yong | H01Q 1/2283 |
| 2020/0212577 | A1 * | 7/2020 | Xia | H01Q 9/0414 |

* cited by examiner

*Primary Examiner* — Haissa Philogene
(74) *Attorney, Agent, or Firm* — W&G Law Group LLP

(57) ABSTRACT

An AOG antenna system and a mobile terminal are provided. The AOG antenna system includes an Antenna in Package (AiP) disposed between the main board and the 3D glass back cover and electrically connected to the main board, and a metal antenna formed on a surface of the 3D glass back cover. The metal antenna includes a first antenna attached to an inner surface of the 3D glass back cover and a second antenna attached to an outer surface of the 3D glass back cover. A position of the first antenna corresponds to a position of the AiP and is fed with power by coupling to the AiP, and a position of the second antenna corresponds to the position of the first antenna and is fed with power by coupling to the first antenna.

16 Claims, 8 Drawing Sheets

AOG ANTENNA SYSTEM AND MOBILE TERMINAL

TECHNICAL FIELD

The present disclosure relates to the field of wireless communication technologies, and in particular, to an Antenna On Glass (AOG) antenna system and a mobile terminal.

BACKGROUND 5G is the research and development focus of the global industry, and it has become the industry consensus to develop the 5G technology and formulate 5G standards. At the 22$^{nd}$ ITU meeting of ITU-RWP5D held in June 2015, the ITU defined three main application scenarios of 5G: enhanced mobile broadband, large-scale machine communication, and high-reliability low-latency communication. The three application scenarios correspond to different key indexes. Under the enhanced mobile broadband scenario, the user peak rate is 20 Gbps, and the minimum user experience rate is 100 Mbps. At present, 3GPP is standardizing the 5G technology. The first 5G non-independent networking (NSA) international standard was officially completed and frozen in December 2017, and it is planned to complete a 5G independent networking standard in June 2018. During the 3GPP conference, many key technologies and system architecture research work were quickly focused, including the millimeter wave technology. Unique characteristics of high carrier frequency and large bandwidth of the millimeter wave are main means to realize an ultra-high data transmission rate of 5G.

Abundant bandwidth resources of millimeter wave frequency bands guarantee a high-speed transmission rate, but because of the severe space loss of electromagnetic waves in this frequency band, the wireless communication system using millimeter wave frequency bands needs to adopt a phased-array architecture. Phases of each array element are distributed according to a certain rule through a phase shifter to form a high-gain beam, and the beam is scanned within a spatial range through the change of phase shift.

As an indispensable part of a radio-frequency front-end system, system integration and encapsulation of an antenna and a radio-frequency front-end circuit become an inevitable trend in the future radio-frequency front-end circuit development while the radio-frequency circuit is developing towards integration and miniaturization. An antenna in package (AiP) technology integrates an antenna into a package carrying a chip by packaging materials and processes, which gives good consideration to the antenna performance, cost and volume, and is favored by the majority of chip and package manufacturers. At present, QUALCOMM, INTEL, IBM and other companies have adopted the AiP technology. Undoubtedly, the AiP technology will also provide a good antenna solution for 5G MMW mobile communication systems.

A metal frame cooperating with 3D glass is the mainstream of the future full screen phone structure design, which can provide better protection, aesthetics, thermal diffusion, color, and user experience. However, due to the high dielectric constant of the 3D glass, the radiation performance of the millimeter wave antenna will be seriously affected and the gain of the antenna array will be reduced.

Therefore, it is necessary to provide a novel antenna system and a novel mobile terminal so as to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding portions throughout the several views.

DESCRIPTION OF EMBODIMENTS

The present invention will be further illustrated with reference to the accompanying drawings and the embodiments.

Figure 1:
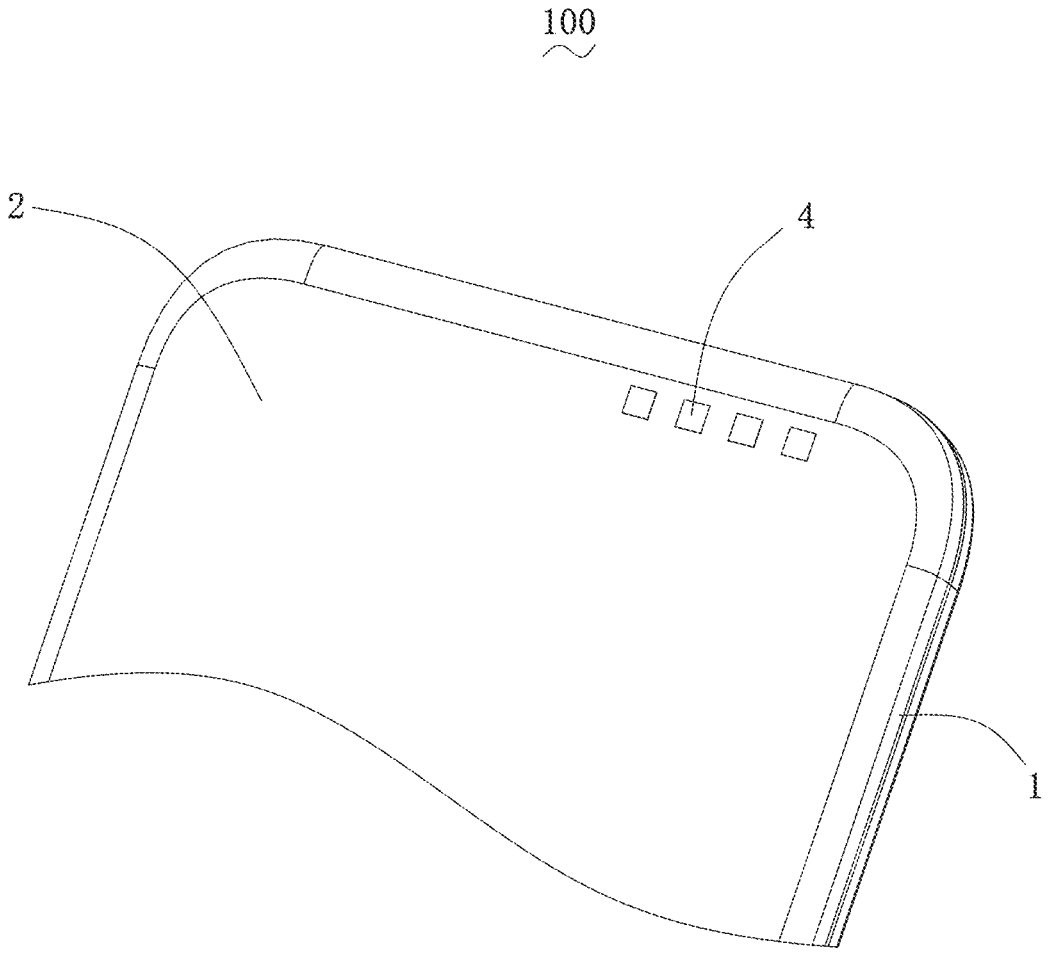
FIG. 1 is a structural schematic diagram of a mobile terminal according to the present disclosure.
Figure 2:
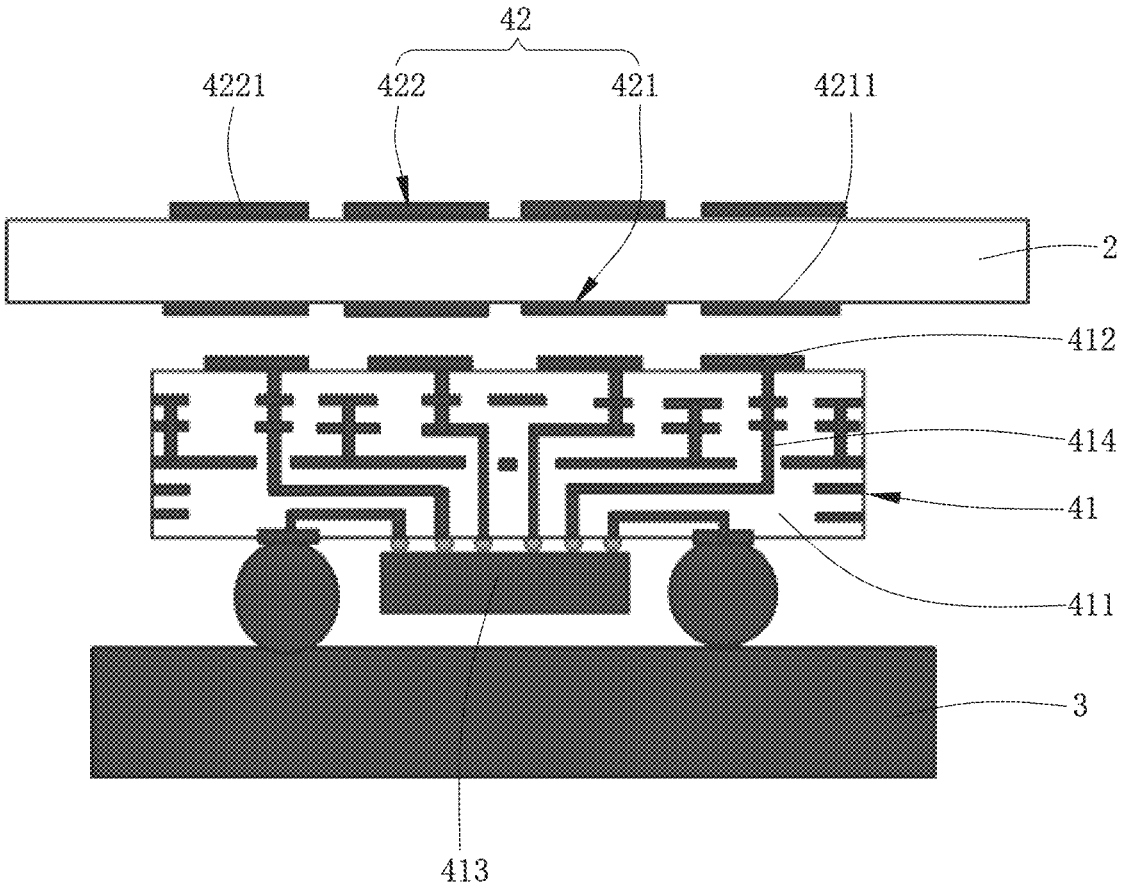
FIG. 2 is a schematic diagram of connections between a 3D glass back cover, an AOG antenna system, and a main board in the mobile terminal shown in FIG. 1.
Figure 3:
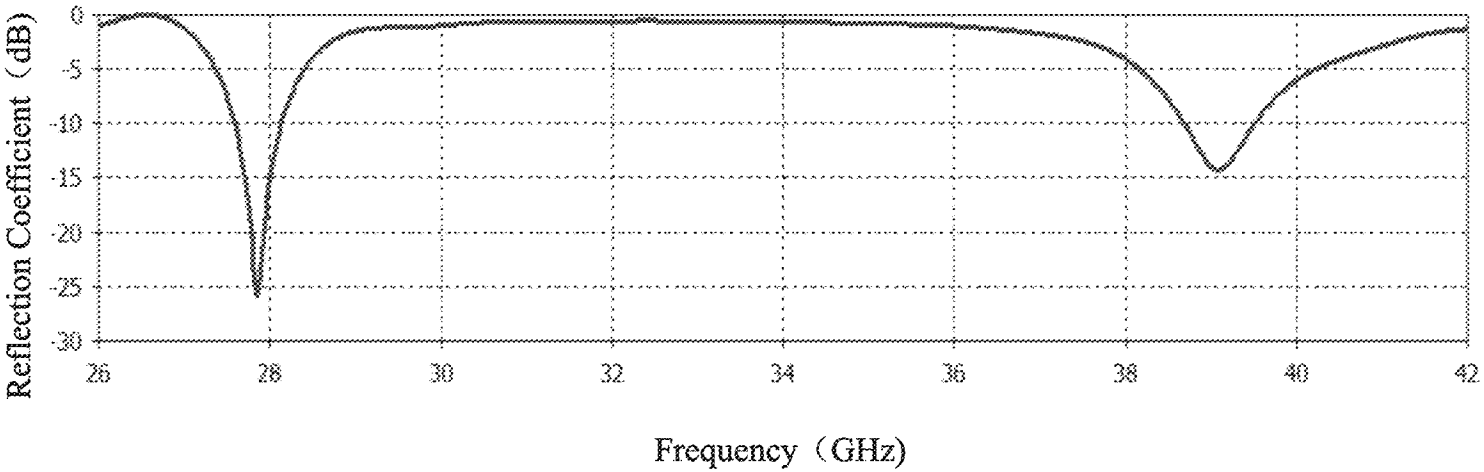
FIG. 3 is a curve graph of a reflection coefficient of the AOG antenna system according to the present disclosure.

As shown in FIGS. 1-2, the present disclosure provides a mobile terminal 100. The mobile terminal 100 may be a mobile phone, an iPad, a POS machine, and so on, which is not limited in the present disclosure. The mobile terminal 100 includes a frame 1, a 3D glass back cover 2 covering the frame 1 and enclosing a receiving space together with the frame 1, a main board 3 received in the receiving space and spaced apart from the 3D glass back cover 2, and an AOG antenna system 4. The 3D glass back cover 2 can cover the frame 1 by an adhesive, or a corresponding snap structure can be disposed on the frame 1 and the 3D glass back cover 2 respectively, so that the 3D glass back cover 2 can be fixedly connected to the frame 1 by clamping, or the frame 1 is integrally formed with the 3D glass back cover. The 3D glass back cover 2 can provide better protection, aesthetics, thermal diffusion, color, and user experience. The AOG antenna system 4 can receive and send electromagnetic signals, thereby implementing a communication function of the mobile terminal 100.

The AOG antenna system 4 is a millimeter-wave phased array antenna system. Specifically, the AOG antenna system 4 includes an AiP 41 disposed between the main board 3 and the 3D glass back cover 2 and electrically connected to the main board 3, and a metal antenna 42 formed on a surface of the 3D glass back cover 2. The metal antenna 42 corresponds to the position of the AiP 41.

Specifically, the AiP 41 includes a substrate 411, multiple AiP units 412 disposed on one side of the substrate 411 facing towards the 3D glass back cover 2, an integrated circuit chip 413 disposed on one side of the substrate 411 facing away from the 3D glass back cover 2, and a circuit 414 disposed in the substrate 411 and connected to the AiP units 412 and the integrated circuit chip 413, and the circuit 414 is connected to the main board 3. Specifically, the AiP 41 can be connected to the main board 3 by a BGA package technology.

The metal antenna 42 includes a first antenna 421 attached to an inner surface of the 3D glass back cover 2 and a second antenna 422 attached to an outer surface of the 3D glass back cover 2, and the first antenna 421 is disposed corresponding to the second antenna 422. It should be noted that the inner surface of the 3D glass back cover 2 is a side facing towards the main board 3, and the outer surface of the 3D glass back cover 2 is a side facing away from the main board 3.

The AOG antenna system 4 is a dual-frequency antenna system. Specifically, the first antenna 421, the second antenna 422, and the AiP 41 are coupled to generate a first resonant frequency and a second resonant frequency, thus implementing dual-frequency coverage of the AOG antenna system 4. In this embodiment, the first resonant frequency is a frequency band of 28 GHz, and the second resonant frequency is a frequency band of 39 GHz. Meanwhile, the second antenna 422 can also functions directing effect to improve the gain of the AOG antenna system 4.

Further, the AiP 41 and the metal antenna 42 are both a one-dimensional linear matrix, which narrow the space occupied by the millimeter-wave array in the mobile phone and only needs to scan one angle, thus simplifying the design difficulty, test difficulty and complexity of beam management. Optionally, the AiP 41 is a 1*4 linear matrix, and the metal antenna 42 is also a 1*4 linear matrix. Namely, the AiP 41 includes four AiP units 412, the first antenna 421 includes four first antenna units 4211, the second antenna 422 includes four second antenna units 4221, and each of the first antenna units 4211 is spaced apart from and coupled to one of the AiP units 412. Each of the second antenna units 4221 is spaced apart from and coupled to one of the first antenna units 4211. Each of the AiP units 412 is connected to a phase shifter, which is a 5-bit phase shifter with a precision of 11.25°.

Furthermore, the AiP 41 is selected from one of a square patch antenna, a ring patch antenna, a circular patch antenna, and a cross-shaped patch antenna. The metal antenna 42 is selected from one of a square patch antenna, a ring patch antenna, a circular patch antenna, and a cross-shaped patch antenna. Optionally, the AiP 41 and the metal antenna 42 are both a square patch antenna. Definitely, in other embodiments, the AiP 41 and the metal antenna 42 may also be other forms of antennas.

Meanwhile, in this embodiment, the 3D glass back cover 2 has a dielectric constant of 6.3+i0.039 and a thickness of 0.7 mm. The substrate 411 of the AiP 41 is made by laminating six layers of high-frequency low-loss PCB plates, of which the core layer is Rogers4350B and has a thickness of 0.254 mm, and the remaining dielectric layers are laminated by Rogers4450F and have a thickness of 0.2 mm. Definitely, it should be noted that neither the dielectric constant of the 3D glass back cover 2 nor the number of layers, the thickness, and the manufacturing mode of the substrate 411 of the AiP 41 are limited in this application.

Each surface of the 3D glass back cover 2 can be designed as a flat surface, or some surfaces can be designed as flat surfaces, and the other surfaces can be designed as a curved surface to meet the needs of different users on the product. The metal antenna 42 is formed on the surface of the 3D glass back cover 2 by a printing conductive silver paste method or a printing LDS ink method. Meanwhile, to avoid the influence of the second antenna 422 on the aesthetics of the mobile terminal 100, the second antenna 422 can be designed near the Logo, or a protective film is applied on the surface of the second antenna 422, which not only avoids affecting the aesthetics but also protects the antenna. The protective film is preferably a low dielectric layer film or plastic.

Figure 4:
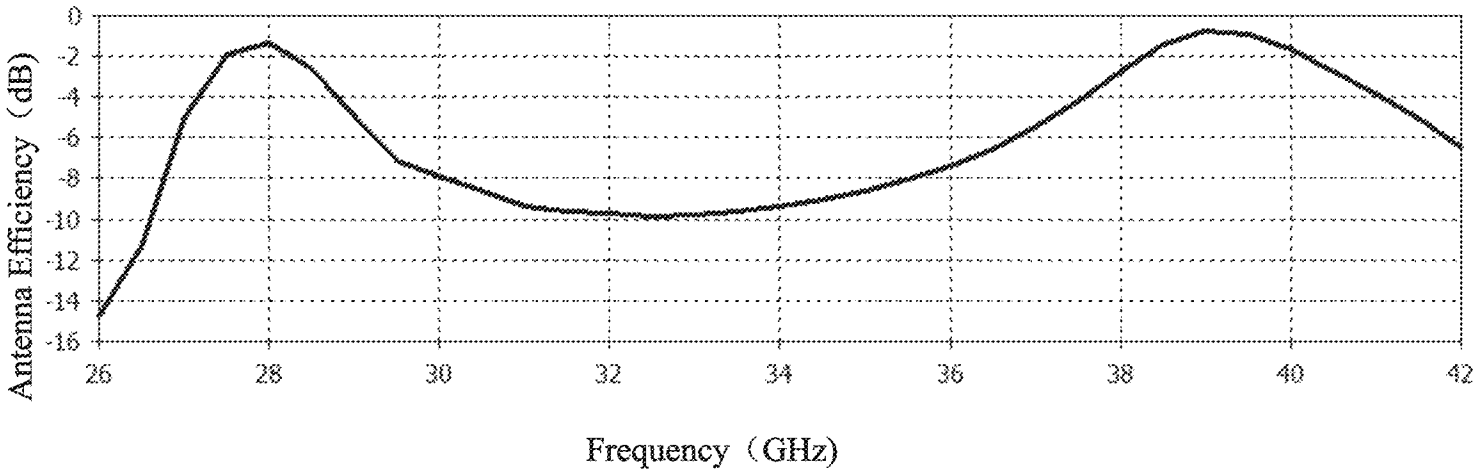
FIG. 4 is a curve graph of an antenna efficiency of the AOG antenna system according to the present disclosure.
Figure 5A:
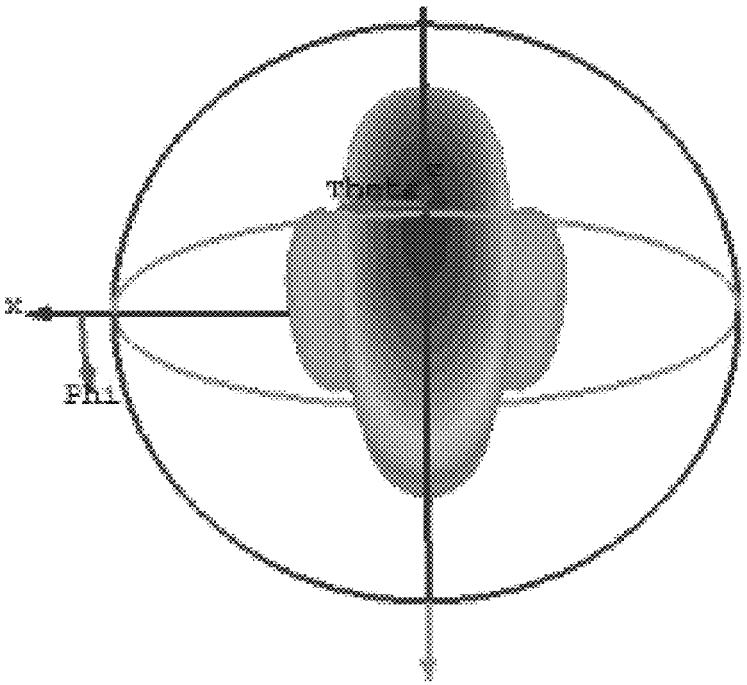
FIG. 5A is a diagram of a radiation direction in which phase shift of each AiP unit is 0° when the AOG antenna system according to the present disclosure is at 28 GHz.
Figure 5B:
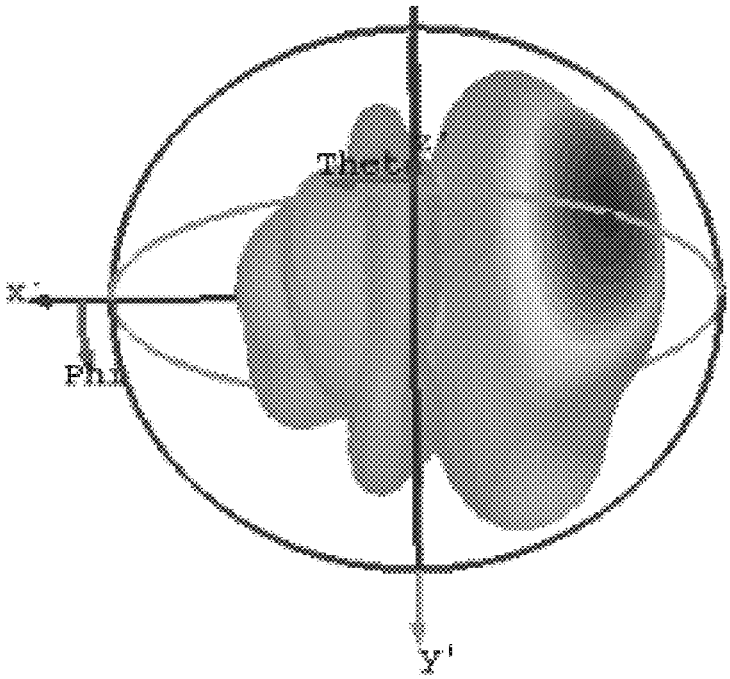
FIG. 5B is a diagram of a radiation direction in which phase shift of each AiP unit is 45° when the AOG antenna system according to the present disclosure is at 28 GHz.
Figure 6A:
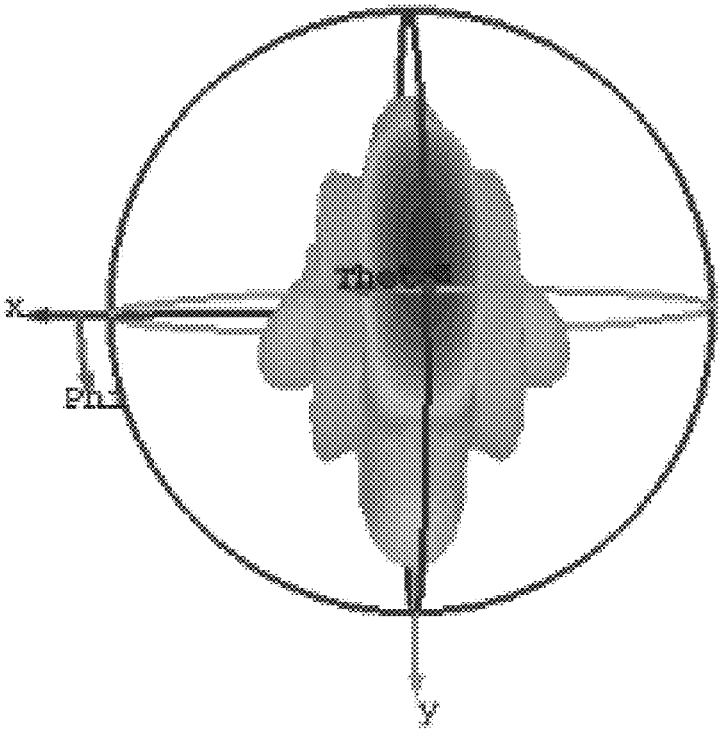
FIG. 6A is a diagram of a radiation direction in which phase shift of each AiP unit is 0° when the AOG antenna system according to the present disclosure is at 39 GHz.
Figure 6B:
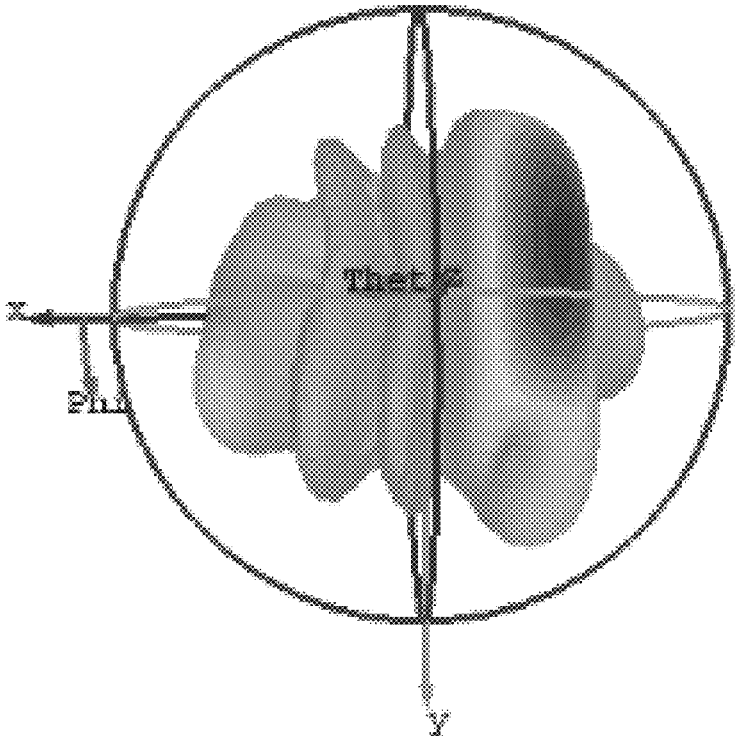
FIG. 6B is a diagram of a radiation direction in which phase shift of each AiP unit is 45° when the AOG antenna system according to the present disclosure is at 39 GHz.

Referring to FIG. 3 to FIG. 6A, FIG. 3 is a curve graph of a reflection coefficient of an AOG antenna system 4 according to the present disclosure; FIG. 4 is a curve graph of an antenna efficiency of the AOG antenna system 4 according to the present disclosure; FIG. 5A is a diagram of a radiation direction in which phase shift of each AiP unit 412 is 0° when the AOG antenna system 4 according to the present disclosure is at 28 GHz; FIG. 5B is a diagram of a radiation direction in which phase shift of each AiP unit 412 is 45° when the AOG antenna system 4 is at 28 GHz; FIG. 6A is a diagram of a radiation direction in which phase shift of each AiP unit 412 is 0° when the AOG antenna system 4 according to the present disclosure is at 39 GHz; and FIG. 6B is a diagram of a radiation direction in which phase shift of each AiP unit 412 is 45° when the AOG antenna system 4 is at 39 GHz.

Generally, as 3D glass has a high dielectric constant of 6.3+i0.039, the back cover of the mobile phone will seriously affect the radiation performance of the antenna system received therein, reduce the radiation efficiency, reduce the gain and distort the radiation pattern due to the influence of surface waves. In the present disclosure, by using the 3D glass back cover 2 as the dielectric substrate of the antenna, the influence of the 3D glass back cover 2 on the internal AiP 41 can be greatly reduced while the dual-frequency coverage is achieved, thus improving the antenna efficiency and avoiding the distortion of the radiation pattern.

Figure 7A:
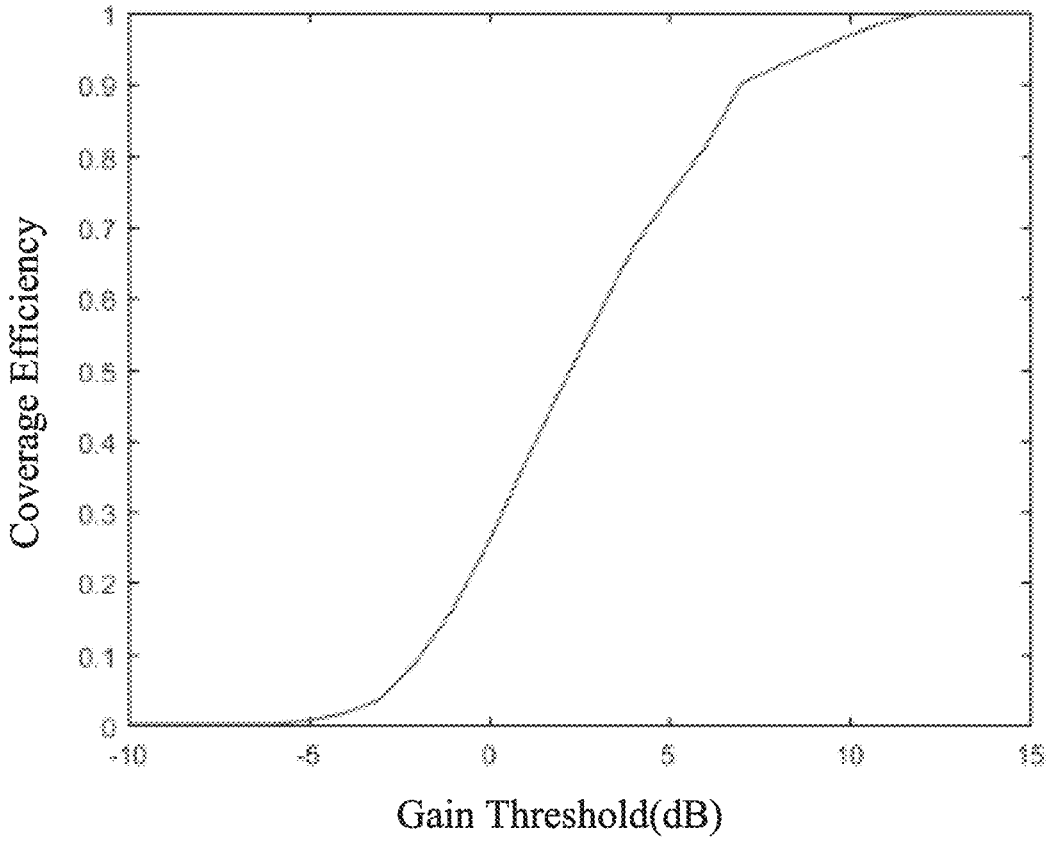
FIG. 7A is a curve graph of a coverage efficiency when the AOG antenna system according to the present disclosure is at a frequency band of 28 GHz.
Figure 7B:
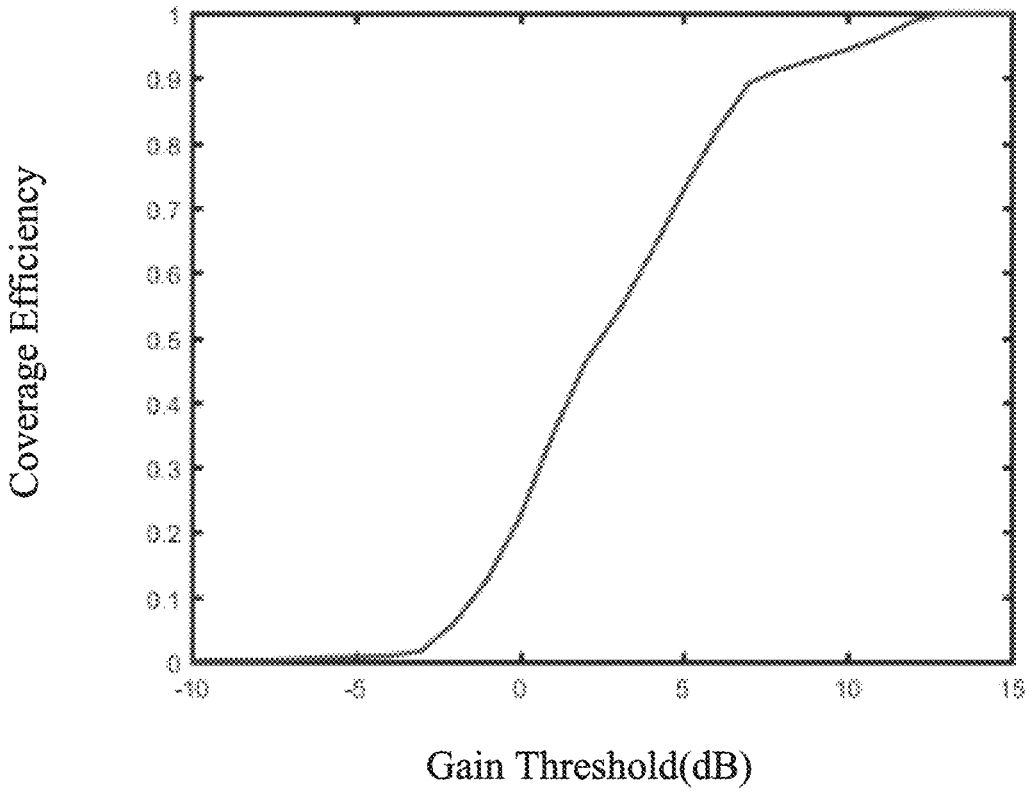
FIG. 7B is a curve graph of a coverage efficiency when the AOG antenna system according to the present disclosure is at a frequency band of 39 GHz.

Referring to FIG. 7A and FIG. 7B, FIG. 7A is a curve graph of a coverage efficiency when the AOG antenna system 4 according to the present disclosure is at a frequency band of 28 GHz; and FIG. 7B is a curve graph of a coverage efficiency when the AOG antenna system 4 according to the present disclosure is at a frequency band of 39 GHz. It can be known from FIG. 7A and FIG. 7B that when the coverage efficiency is 50%, the gain threshold of AOG antenna system 4 in the frequency bands of 28 GHz and 39 GHz is decreased by 9.5 dB, while in the discussion of 3GPP, for the coverage efficiency of 50%, the gain threshold is decreased by 12.98 dB. Therefore, it indicates that AOG antenna system 4 of the present disclosure has a better coverage efficiency.

Compared with the related art, the AOG antenna system 4 and the mobile terminal 100 provided in the present disclosure have the following beneficial effects. By disposing a metal antenna 42 coupled to the AiP 41 on the surface of the 3D glass back cover 2, the influence of the 3D glass back cover on the AiP 41 inside the mobile terminal 100 is greatly reduced. As a result, the antenna radiation efficiency is high and the gain reduction is small, thus ensuring the communication effect. The millimeter-wave phased array antenna system uses a linear array instead of a planar array, which narrows the space occupied in the mobile phone and only needs to scan one angle, thus simplifying the design difficulty, test difficulty and complexity of beam management. Meanwhile, the metal antenna 42 includes a first antenna 421 and a second antenna 422, and the first antenna 421 is coupled to the second antenna 422, which can implement dual-frequency coverage of the AOG antenna system 4.

The above are merely the embodiments of the present disclosure, which do not limit the patent scope of the present disclosure. Any equivalent structures or equivalent process transformations made according to the specification and contents of the drawings of the present disclosure, or those directly or indirectly applied to other related technical fields, shall all fall in the patent protection scope of the present disclosure.

What is claimed is:

1. An AOG antenna system, applied to a mobile terminal comprising a 3D glass back cover and a main board opposite to and spaced apart from the 3D glass back cover, wherein the AOG antenna system comprises:

an Antenna in Package (AiP) disposed between the main board and the 3D glass back cover and electrically connected to the main board; and a metal antenna formed on a surface of the 3D glass back cover, the metal antenna comprising a first antenna attached to an inner surface of the 3D glass back cover and a second antenna attached to an outer surface of the 3D glass back cover, wherein a position of the first antenna corresponds to a position of the AiP and the first antenna is fed with power by coupling to the AiP, and a position the second antenna corresponds to the position of the first antenna and the second antenna is fed with power by coupling to the first antenna.

2. The AOG antenna system as described in claim 1, wherein the AiP comprises a substrate, a plurality of AiP units disposed on one side of the substrate facing towards the 3D glass back cover, an integrated circuit chip disposed on one side of the substrate facing away from the 3D glass back cover, and a circuit disposed in the substrate and connecting the plurality of AiP units with the integrated circuit chip, the circuit being connected to the main board.

3. The AOG antenna system as described in claim 2, wherein the AOG antenna system is a millimeter-wave phased array antenna system.

4. The AOG antenna system as described in claim 3, wherein the metal antenna and the AiP are both one-dimensional linear matrixes, the first antenna comprises a plurality of first antenna units, the second antenna comprises a plurality of second antenna units, and each of the plurality of first antenna units is spaced apart from and coupled to one of the plurality of AiP units; and each of the plurality of second antenna units is spaced apart from and coupled to one of the plurality of first antenna units.

5. The AOG antenna system as described in claim 1, wherein the metal antenna is formed on the surface of the 3D glass back cover by a printing conductive silver paste method or a printing LDS ink method.

6. The AOG antenna system as described in claim 1, wherein the AiP is selected from a group consisting of a square patch antenna, a ring patch antenna, a circular patch antenna, and a cross-shaped patch antenna.

7. The AOG antenna system as described in claim 1, wherein the metal antenna is selected from a group consisting of a square patch antenna, a ring patch antenna, a circular patch antenna, and a cross-shaped patch antenna.

8. The AOG antenna system as described in claim 1, wherein a surface of the metal antenna is covered with a protective film.

9. The AOG antenna system as described in claim 1, wherein the AOG antenna system is a dual-frequency antenna system.

10. A mobile terminal, comprising the AOG antenna system as described in claim 1.

11. The mobile terminal as described in claim 10, wherein the AiP comprises a substrate, a plurality of AiP units disposed on one side of the substrate facing towards the 3D glass back cover, an integrated circuit chip disposed on one side of the substrate facing away from the 3D glass back cover, and a circuit disposed in the substrate and connecting the plurality of AiP units with the integrated circuit chip, the circuit being connected to the main board.

12. The mobile terminal as described in claim 11, wherein the AOG antenna system is a millimeter-wave phased array antenna system.

13. The mobile terminal as described in claim 12, wherein the metal antenna and the AiP are both one-dimensional linear matrixes, the first antenna comprises a plurality of first antenna units, the second antenna comprises a plurality of second antenna units, and each of the plurality of first antenna units is spaced apart from and coupled to one of the plurality of AiP units; and each of the plurality of second antenna units is spaced apart from and coupled to one of the plurality of first antenna units.

14. The mobile terminal as described in claim 10, wherein the metal antenna is formed on the surface of the 3D glass back cover by a printing conductive silver paste method or a printing LDS ink method.

15. The mobile terminal as described in claim 10, wherein the AiP is selected from a group consisting of a square patch antenna, a ring patch antenna, a circular patch antenna, and a cross-shaped patch antenna.

16. The mobile terminal as described in claim 10, wherein the metal antenna is selected from a group consisting of a square patch antenna, a ring patch antenna, a circular patch antenna, and a cross-shaped patch antenna.

* * * * *